US005419518A

United States Patent [19]

Fiorenzo

[11] Patent Number: 5,419,518

[45] Date of Patent: May 30, 1995

[54] RAILROAD SWITCH STAND HAVING FOOT AND HAND ACCOMMODATING THROW HANDLE

[75] Inventor: Albert V. Fiorenzo, South Chicago Heights, Ill.

[73] Assignee: ABC Rail Corporation, Chicago, Ill.

[21] Appl. No.: 360,133

[22] Filed: Dec. 20, 1994

Related U.S. Application Data

[63] Continuation of Ser. No. 123,893, Sep. 20, 1993, abandoned.

[51] Int. Cl.[6] ..... B61L 5/02

[52] U.S. Cl. ..... 246/410; 246/489; 74/543; 254/DIG. 3; 16/110 R

[58] Field of Search ..... 246/393, 407, 410, 412, 246/489; 74/519, 523, 543; 254/17, 44, DIG. 3; 16/110 R

[56] References Cited

U.S. PATENT DOCUMENTS

| | | | |
|---|---|---|---|
| 1,289,713 | 12/1918 | Evans | 246/410 |
| 1,901,778 | 3/1933 | Schlag | 16/110 R |
| 2,610,291 | 9/1952 | McGarry | 246/410 X |
| 3,088,350 | 5/1963 | Stilwell | 74/519 X |
| 3,136,574 | 6/1964 | Pasquale | 16/110 R X |
| 3,236,539 | 2/1966 | Ketterer | 16/110 R X |

*Primary Examiner*—Robert J. Oberleitner
*Assistant Examiner*—S. Joseph Morano
*Attorney, Agent, or Firm*—Thomas S. Baker, Jr.

[57] ABSTRACT

A manually-operable railroad switch stand for causing movement of railroad switch points between two extreme operating positions is provided with a crank assembly that is connected to the switch stand input shaft for joint rotation and that has a pair of parallel and substantially laterally spaced-apart handle pull-push segments which are each of sufficient length to alternatively accommodate an operator's hand or an operator's foot and which each may be selectively hand-grasped or foot-engaged by the switch stand operator without having to significantly bend his/her spinal column at the waist when manually causing movement of the switch points between the switch extreme operating positions thus avoiding possible costly operator spinal injury.

10 Claims, 1 Drawing Sheet

RAILROAD SWITCH STAND HAVING FOOT AND HAND ACCOMMODATING THROW HANDLE

This application is a continuation of application Ser. No. 08/123,893, filed Sep. 20, 1993, now abandoned.

FIELD OF THE INVENTION

This invention relates generally to railroad track switching, and particularly concerns a railroad switch stand which may be actuated manually by railroad operating personnel with reduced physical stress.

BACKGROUND OF THE INVENTION

Railroad switch stands currently offered and utilized in the United States by its rail transportation industry are available in many different construction and operation configurations. Some railroad switch stands are operated using primarily manual input forces, often with automatic reversal if run through by a trailing non-switched train, while other available switch stands are operated remotely using non-manual (e.g., electrical or hydraulic) actuation forces. Such remotely-controlled switch stands generally are provided with manual override actuation capabilities.

Most available manually-operated railroad switch stands provide some form of crank and crank-handle mechanism (sometimes referred to as a lever and handle mechanism) for manual actuation by operating personnel, although other input devices such as a handwheel which drives the switch throw mechanism as through a worm and worm gear combination may be provided to minimize required manual input forces. See, for instance, the railroad switch stand construction disclosed in U.S. Pat. No. 4,938,438 issued in the name of Farrell et al. and assigned to the assignee of this invention.

In the case of railroad switch stands provided with a crank and crank-handle manual actuation mechanism, it is well-known that operating personnel may frequently experience costly serious back injury, generally of the nature of spinal and/or muscular injury, in the course of actuating any of the presently available manually-operable switch stands. Through the application of ergonomic principles to the design of a railroad switch stand, and particularly its manual input crank, I have discovered a switch and crank construction which is effective to reduce the occurrence of the previously-mentioned back injuries to railroad operating personnel.

SUMMARY OF THE INVENTION

The present railroad switch stand invention involves an improved manual-force input crank joined to the input shaft of a railroad switch stand that normally actuates conventional track switch points through a cooperating connecting-rod connection. The switch stand input crank has a crank-arm section that is connected to the switch operating shaft at one of its ends and that is normally oriented horizontally when the switch is in either of its two switched conditions; the crank-arm section normally has a vertical orientation when the switch stand is in its half-throw condition or is half-way through its customary 180-degree crank operating arc. Attached to the other end of the crank-arm section is a handle section which is loop-like in configuration but which differs from known railroad switch stand input crank-arm handles in that it is provided with two generally parallel and laterally spaced apart pull-push segments which each are of sufficient length to accommodate grasping and pulling by a gloved human operator's hand and alternative engagement with and pushing by an operator's shoe-shod foot. Such handle pull-push segments are oriented generally parallel to but substantially off-set from the switch input crank-arm section, and are spaced-apart relative to each other a sufficient distance whereby the switch operator may grasp and pull the uppermost handle pull-push segment upwards with only a moderate bending of his knees and no significant bending of his/her spine from the waist when the crank-arm section is in a throw horizontal position. Similarly, when the switch crank-arm section has been moved from one extreme throw condition to its near-opposite throw condition, final throw movement may be accomplished by the human operator through a downward force applied to the handle lowermost pull-push segment by foot and leg-muscle action without having to significantly bend the spine at the waist region. In one preferred embodiment of this switch stand invention the spaced apart input lever handle pull-push segments are laterally separated by a distance of approximately eighteen inches. To complete the loop-type handle configuration, the pull-push handle segments are joined to the crank-arm section by transition segments, and to each other by a strut segment to provide rigidity to the handle. In a preferred embodiment, the loop-type crank handle section is of integral construction. Additional particulars regarding the invention are provided in the drawings and detailed specification.

DETAILED DESCRIPTION

Figure 1:
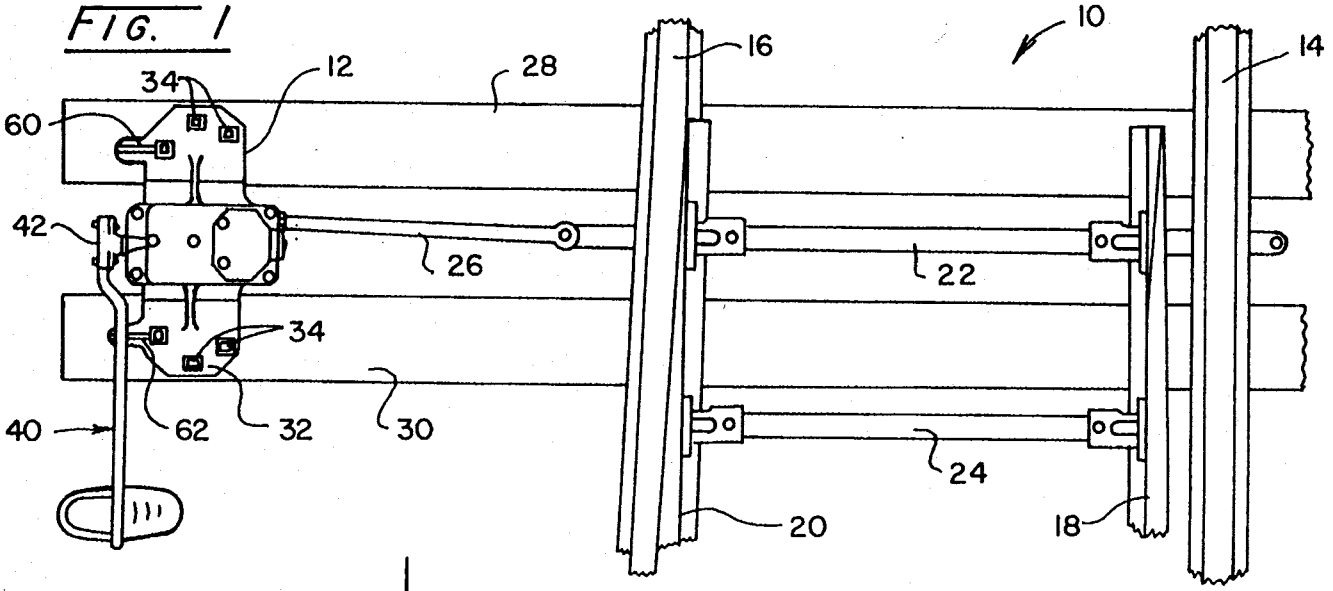
FIG. 1 is a plan view of a portion of a conventional railroad track switch installation having a preferred embodiment of the improved switch stand of this invention incorporated therein.
Figure 3:
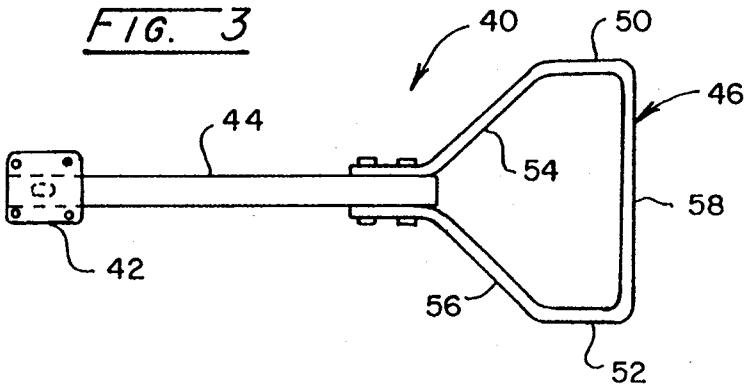
FIG. 3 is an illustration of the switch stand crank-arm and crank-handle construction of FIGS. 1 and 2 switch stand further showing a representative form of attachment flange for connecting the switch stand crank to the switch stand input shaft and its cooperating attachment flange.

FIG. 1 illustrates a portion of a railroad track switch installation (10) having the switch stand (12) of this invention incorporated therein. Installation (10) typically includes representative switch stock rails (14 and 16) and joined switch points (18 and 20). Switch points (18 and 20) are connected to each other for unitary movement by switch rods (22 and 24), and to switch stand (12) for actuation together by connecting rod (26). Various slide plates, heel plates, tie plates, braces, stops, risers, bolts, and other hardware devices for securely mounting the switch rails and switch points on railroad ties (28 and 30) are not illustrated.

Switch stand (12) has a base (32) which mounts the stand on riser blocks (36 and 38) supported on ties (28 and 30) using conventional bolt fasteners (34). In the operating position of switch stand (12) shown in FIG. 1, switch point (20) abuts stock rail (16). Upon operation of the switch stand to its second operating position, the connecting rod (26) and switch rods (22, 24) are moved rightwards such that switch point (18) abuts stock rail

(14) and switch point (20) becomes disengaged and separated from stock rail (16). Thus it may be seen that operation of switch stand (12) between its two operating positions or conditions causes the connecting rod (26) to be extended in one direction to move switch rods (22, 24) and switch points (18, 20) from a position in which one switch point lies against one stock rail to a position in which the opposite switch point lies against the opposite stock rail.

Figure 2:
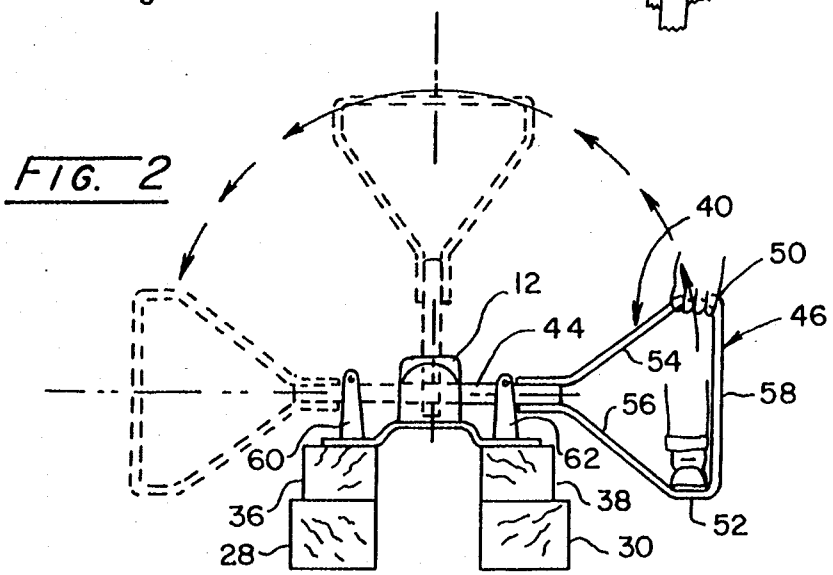
FIG. 2 is an elevational view of the installation of FIG. 1 schematically illustrating the extreme-throw and mid-throw positions of the improved switch stand input crank.

Switch stand (12) includes a manually-operated crank (40) which is preferably secured to the operating shaft of the switch stand by means of a bolted flange connection (42). As best shown in FIG. 2, switch stand crank (40) is basically comprised of a crank-arm section (44) and a crank-handle section (46) securely joined to crank-arm section by suitable fastener means (not illustrated). Crank-handle section (46) has a loop-type configuration and is comprised of several joined segments including generally parallel but laterally spaced apart pull-push segments (50, 52), transition segments (54, 56), and strut segment (58). Pull-push segments (50 and 52) are oriented essentially parallel to crank-arm (44) and are each of sufficient length to easily accommodate a gloved hand or alternatively a shod foot of the switch stand human operator. Such segments are normally about 5 inches in length. Strut segment (58) which joins pull-push segments (50 and 52) is essentially oriented at right angles to those segments and normally is about 18 inches in length. Transition segments (54 and 56) are configured to accommodate the lateral offsets for pull-push segments (50 and 52), and are of sufficient length that segment (58) is located normally about 36 inches from the axis of rotation of crank (40) when joined segments (50 through 58) are secured to crank-handle section (44) as by conventional rivet or threaded bolt and nut fastener devices.

Also illustrated in FIGS. 1 and 2 are the switch stand pedestal-like stops (60 and 62) which are secured to base (32) and which function to limit downward movements of the crank (40) and thus define its operating extreme throw positions. No details are provided in the drawings of the mechanisms such as cams, cranks, and the like included internally in switch stand (12) to convert the rotary motion of crank (40) into linear motion of connecting rod (26) as such devices are well-known in the art.

FIG. 2 illustrates a switch stand operator's hand in grasping engagement with handle pull-push segment (50) and foot in pushing engagement with handle pull-push segment (52) when switch stand (12) is in one of its extreme throw positions. By reason of the substantial laterally spaced-apart relationship between such pull-push segments, the human operator is able to grasp the uppermost pull-push segment with his hand with a moderate bending of the knees and without substantial bending of the spine at the waist. Upward switch stand crank movement is then accomplished by using mostly leg extension movement. Similarly, after the switch crank has been moved by arm and non-spinal body movement to its near-opposite position, the operator's foot is engaged with the lowermost handle pull-push segment. Completion of the required crank movement may be accomplished by transferring operator body weight to the crank-engaged foot without bending the spine either alone or with an additional downward transfer of operator body weight through arm and hand action applied to the then uppermost handle pull-push segment—also without any significant bending of the operator's spine at the waist. Thus, utilization of the improved switch stand (12) in a railroad switch installation provides a basis for the significant reduction of operator back (spinal) injuries that otherwise might occur through manual operation or actuation of such equipment.

Normally the principal components of the improved switch stand are made of various forged steels. However, other materials, component shapes, and component preferred sizes may be utilized in the practice of this invention.

Since certain changes may be made in the above-described system and apparatus not departing from the scope of the invention herein and above, it is intended that all matter contained in the description or shown in the accompanying drawings shall be interpreted as illustrative and not in a limiting sense.

I claim my invention as follows:

1. An assembly for actuating railroad switch points, and comprising:

a switch stand having an input shaft, an output point, and an internal mechanism which converts input shaft rotation into linear motion of the output point;

a connecting rod connecting said switch stand output point to the railroad switch points; and a manually operable crank connected to said switch stand input shaft and having two operating extreme-throw positions, said manually operable crank having a crank handle section with an opening partially defined by a pair of parallel and laterally spaced-apart handle pull-push segments which are parallel to and substantially offset from the crank axis and which are each of sufficient length to alternatively accommodate an operator's hand and an operator's foot inserted within said opening perpendicular to said crank axis and which are spaced apart laterally a sufficient distance whereby an operator may selectively hand-grasp or foot-engage one of said pull-push segments from within said opening in preference to the other from within said opening at each of said crank two operating extreme-throw positions without having to cause significantly spinal bending at the waist.

2. The assembly defined by claim 1 wherein said crank handle pull-push segments are each at least approximately 5 inches long.

3. The assembly defined by claim 1 wherein said crank handle pull-push segments are laterally spaced apart a distance of at least approximately 18 inches.

4. The assembly defined by claim 1 wherein said manually operable crank additionally has a handle strut segment connecting adjacent outer ends of said handle pull-push segments to close said opening, said strut segment being positioned at least approximately 36 inches from the crank connection to the switch stand input shaft.

5. A railroad switch stand manually-operable crank assembly comprising:

a crank arm section;

a loop-like crank handle section joined to one end of said crank arm section; and attachment means joined to the other end of said crank arm section, said loop-like crank handle section having an opening partially defined by a pair of parallel and laterally spaced-apart pull-push segments each said segment additionally being laterally offset from and oriented parallel to the axis of said crank arm section and each being of sufficient length to alternatively accommodate grasping by an operator's hand and engagement by an operator's foot inserted within said opening perpendicular to said crank arm axis.

6. The crank assembly defined by claim 5 wherein said crank-handle pull-push segments are each at least approximately 5 inches long.

7. The crank assembly defined by claim 5 wherein said crank-handle pull-push segments are laterally spaced apart at a distance of at least approximately 18 inches.

8. The crank assembly defined by claim 5 wherein said loop-like crank handle section includes a strut segment, said strut segment being oriented at right angles to said crank arm section and joining adjacent ends of said crank handle pull-push segments to close said opening.

9. The crank assembly defined by claim 7 wherein said crank handle strut segment is at least approximately 18 inches long.

10. The crank assembly defined by claim 8 wherein said crank-arm section and said joined crank-handle section have an overall length along the axis of said crank-arm section of at least approximately 36 inches.

* * * * *